US011616303B2

(12) United States Patent
Tsuchiya

(10) Patent No.: US 11,616,303 B2
(45) Date of Patent: Mar. 28, 2023

(54) FOLDED ANTENNA

(71) Applicant: Yazaki Corporation, Tokyo (JP)

(72) Inventor: Kazuhiko Tsuchiya, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 201 days.

(21) Appl. No.: 17/194,408

(22) Filed: Mar. 8, 2021

(65) Prior Publication Data

US 2021/0288410 A1 Sep. 16, 2021

(30) Foreign Application Priority Data

Mar. 13, 2020 (JP) ..... JP2020-043599

(51) Int. Cl.
*H01Q 9/42* (2006.01)
*H01Q 1/38* (2006.01)
*H01Q 9/40* (2006.01)

(52) U.S. Cl.
CPC ..... *H01Q 9/42* (2013.01); *H01Q 1/38* (2013.01); *H01Q 9/40* (2013.01)

(58) Field of Classification Search
CPC .. H01Q 9/42; H01Q 1/38; H01Q 9/40; H01Q 21/28; H01Q 9/0421; H01Q 1/085; H01Q 1/36; H01Q 1/42; H01Q 1/48; H01Q 1/50
See application file for complete search history.

(56) References Cited

U.S. PATENT DOCUMENTS

| | | | | |
|---|---|---|---|---|
| 6,342,860 | B1 | 1/2002 | Haussler et al. | |
| 2002/0075192 | A1* | 6/2002 | Iwai | H01Q 1/243 343/702 |
| 2004/0183733 | A1* | 9/2004 | Aoyama | H01Q 5/00 343/702 |
| 2019/0288399 | A1* | 9/2019 | Tanaka | H01Q 13/106 |

FOREIGN PATENT DOCUMENTS

| | | | |
|---|---|---|---|
| JP | 1041736 | A | 2/1998 |
| JP | 2002-223114 | A | 8/2002 |
| JP | 2003008331 | A | 1/2003 |
| JP | 2006303973 | A | 11/2006 |
| JP | 2013-017034 | A | 1/2013 |

* cited by examiner

*Primary Examiner* — David E Lotter
(74) *Attorney, Agent, or Firm* — Sughrue Mion, PLLC

(57) ABSTRACT

A folded antenna includes: a substrate including a dielectric base material and a ground disposed on a first surface of the dielectric base material; and an antenna element including a bent portion bent in a direction perpendicular to the substrate, and a folded portion further bent in a direction parallel to the substrate from the bent portion and capacitively coupled to the ground via the dielectric base material. An impedance of the folded antenna is adjusted by adjusting an area of the folded portion by changing a width dimension of the folded portion without changing a height dimension of the bent portion.

4 Claims, 6 Drawing Sheets

FOLDED ANTENNA

CROSS-REFERENCE TO RELATED APPLICATIONS

The present application is based on, and claims priority from Japanese Patent Application No. 2020-043599, filed on Mar. 13, 2020, the entire contents of which are incorporated herein by reference.

TECHNICAL FIELD

The disclosure relates to a compact and low profile folded antenna.

BACKGROUND

This type of folded antenna is disclosed in Patent Document 1 (JP 2013-017034 A). The folded antenna disclosed in Patent Document 1 includes an upstanding element erected on a conductive ground, and an antenna element fed at a bent portion and having a tip connected to the upstanding element via a first element, a connection element, and the folded element.

The impedance is adjusted by changing (adjusting) the height dimension from the ground to each element of the antenna element. Furthermore in order to maximize the gain of the folded antenna in the vertical polarization/horizontal plane (parallel plane to the ground), it is necessary to maximize the height dimension.

SUMMARY

In the folded antenna disclosed in Patent Document 1, when the impedance is adjusted, the height is changed again to secure the impedance performance, but at this time, there is a possibility that the gain characteristic is lowered.

The present application has been made in view of the problems of such a background art. An object or the present application is to provide a compact and low-profile folded antenna capable of adjusting impedance and stabilizing input impedance while keeping gain of the antenna high.

A folded antenna according to an embodiment includes: a substrate including a dielectric base material and a ground disposed on a first surface of the dielectric base material; and an antenna element including a bent portion bent in a direction perpendicular to the substrate, and a folded portion further bent in a direction parallel to the substrate from the bent portion and capacitively coupled to the ground via the dielectric base material. An impedance of the folded antenna is adjusted by adjusting an area of the folded portion by changing a width dimension of the folded portion without changing a height dimension of the bent portion.

The antenna element may include: a first element having, on one end side, a feeding portion and a first bent portion; and a second element continuously provided, on one end side, with other end side of the first element via a first folding portion, and having, on other end side, a second folded portion via a second bent portion. Then, the folded portion is the second folded portion, the bent portion is the second bent portion, and the impedance of the antenna element is adjusted by adjusting the area of the second folded portion by changing the width dimension of the second folded portion without changing the height dimension of the second bent portion.

The ground may be a copper foil formed on an entire surface of the first surface of the dielectric base material.

The folded portion may have a rectangular plate shape which is bent inward in an L-shape from the bent portion, and the folded portion having the rectangular plate shape is fixed by soldering to a fixing pattern formed on a second surface of the dielectric base material.

According to the embodiment, it is possible to provide a compact and low-profile folded antenna which can adjust the impedance and stabilize the input impedance while keeping the gain of the antenna high.

DETAILED DESCRIPTION

Hereinafter, a folded antenna according to an embodiment will be described in detail with reference to the drawings.

Figure 1:
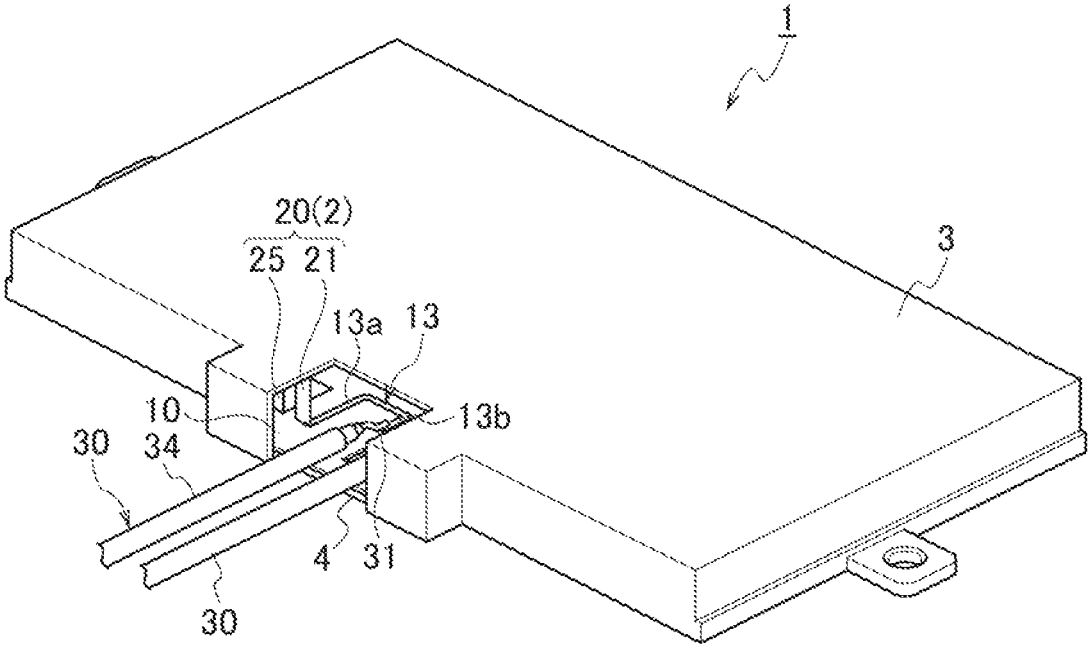
FIG. 1 is a perspective view illustrating an example of a folded antenna according to an embodiment.
Figure 2:
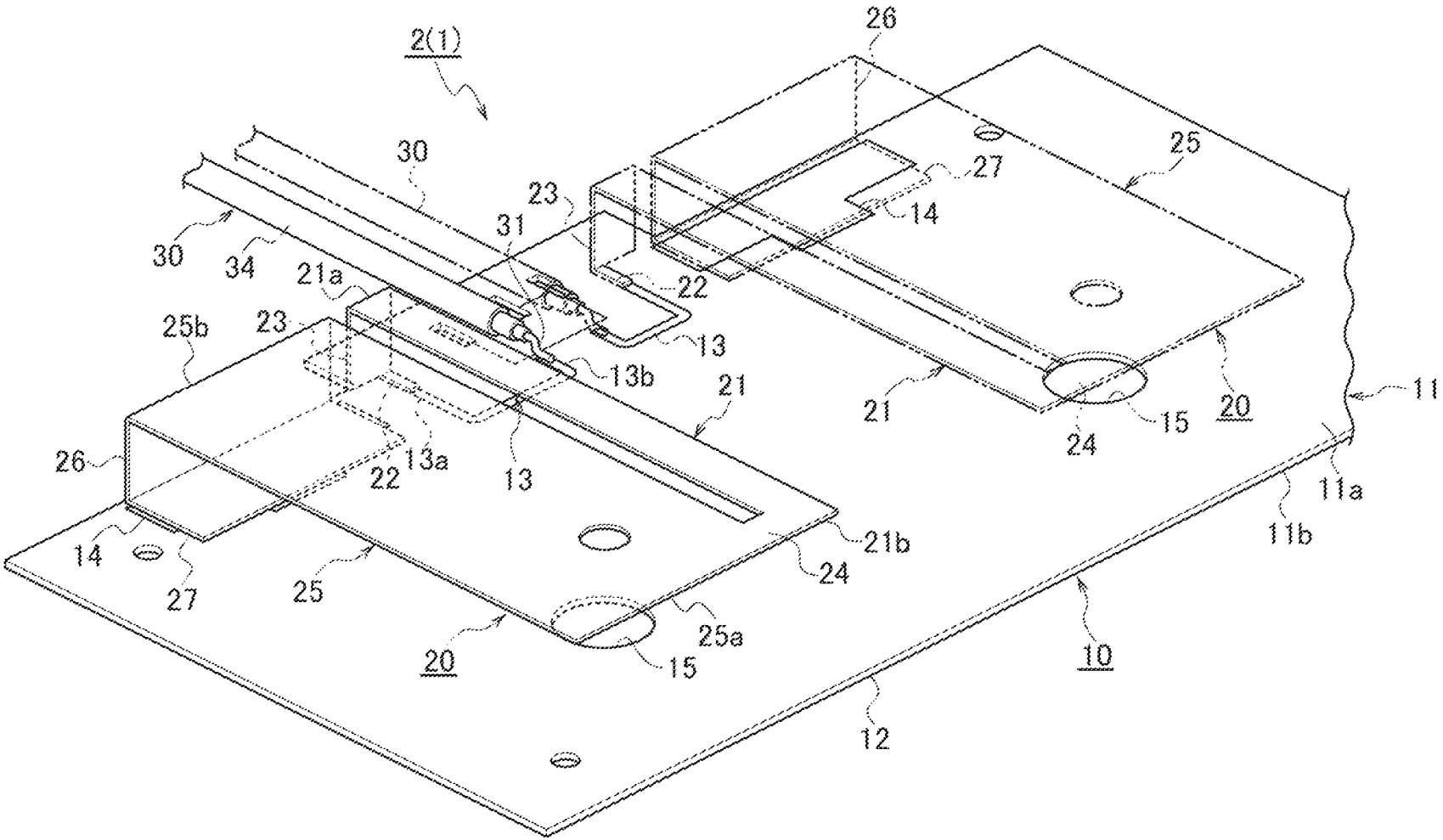
FIG. 2 is a perspective view of an antenna unit of the folded antenna according to the embodiment.

As illustrated in FIGS. 1 and 2, the folded antenna 1 according to the embodiment is configured such that an antenna unit 2 including one substrate 10 and a pair of antenna elements 20 is accommodated between a box-shaped upper lid 3 having an opening on a lower surface side and a rectangular plate-shaped lower lid 4. That is, the folded antenna 1 includes the pair of antenna elements 20 formed symmetrically to the left and right as two antennas. The pair of antenna elements 20 are supplied with power via a pair of coaxial cables 30.

Figure 4:
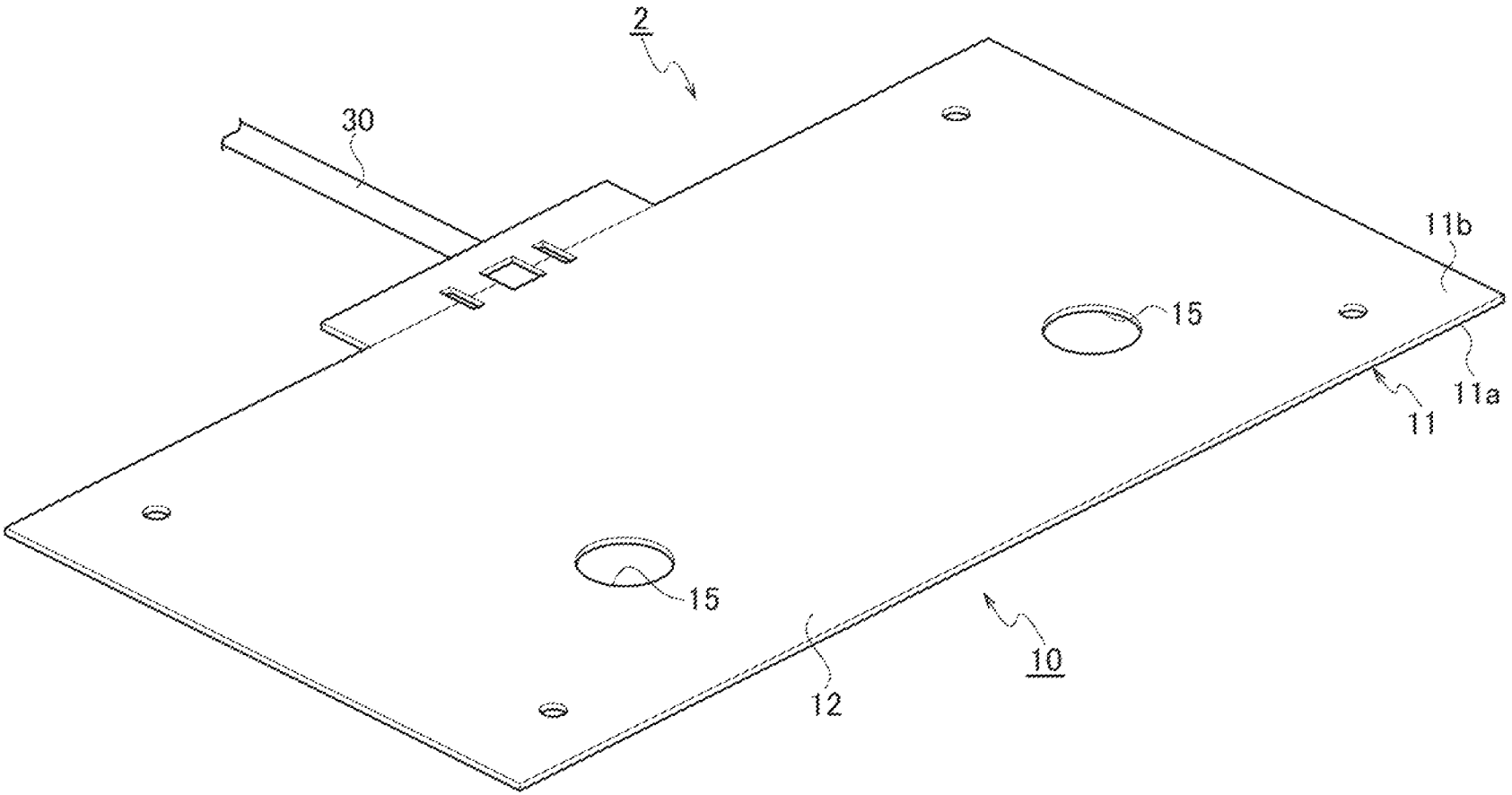
FIG. 4 is a perspective view of the antenna unit of the folded antenna according to the embodiment as viewed from a rear side.
Figure 6:
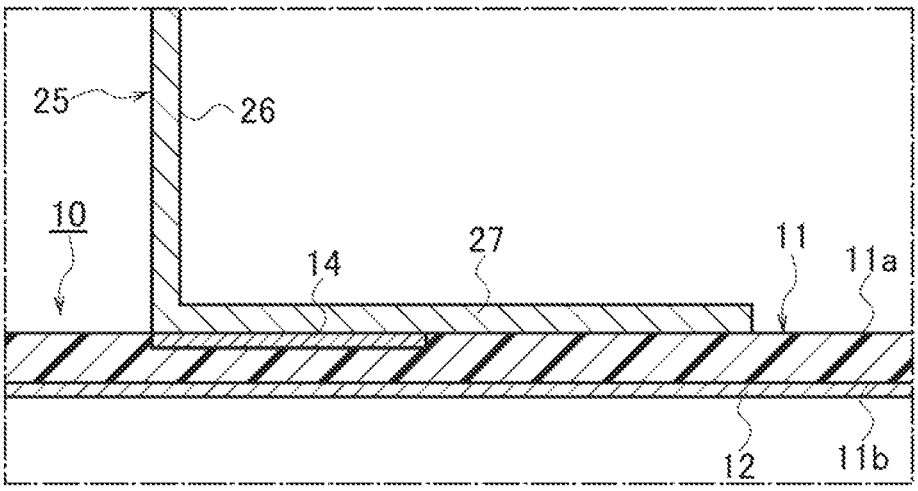
FIG. 6 is an enlarged cross-sectional view of X portion of FIG. 5.

As illustrated in FIGS. 4 and 6, the substrate 10 includes a dielectric base material 11 and a copper foil 12 formed on the entire of a rear surface (first surface) 11*b* of the dielectric base material 11, the copper foil 12 acting as a ground. As illustrated in FIG. 2, at the center of one side of a front surface (second surface) 11*a* of the dielectric base material 11, a pair of U-shaped striplines 13 through which electric power supplied from each coaxial cable 30 flows are formed. On both sides of one side of the front surface 11*a* of the dielectric base material 11, a pair of fixing patterns 14 for fixing each second folded portion 27 by soldering are formed. On the substrate 10, a pair of round holes 15 are formed.

Figure 3:
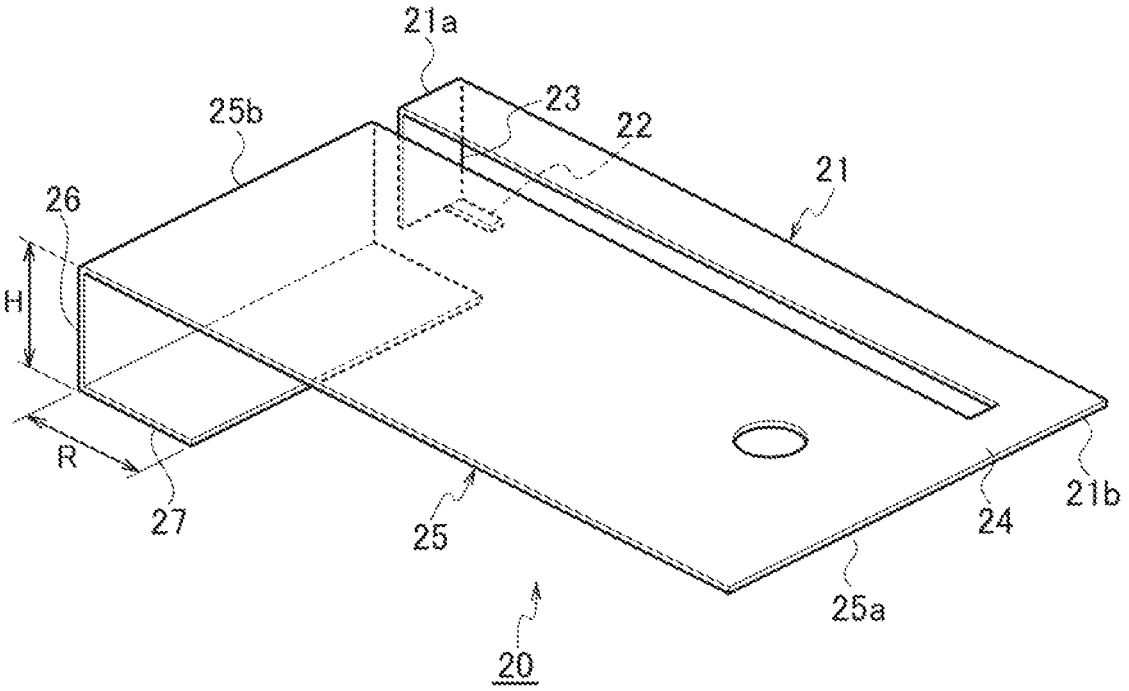
FIG. 3 is a perspective view of an antenna element of the antenna unit of the folded antenna according to the embodiment.

As illustrated in FIGS. 2 and 3, each antenna element 20 includes a first element 21 and a second element 25 formed by bending a rectangular metal plate, and functions as a folded antenna 1 to radiate a radio wave of a desired frequency.

As illustrated in FIGS. 2 and 3, on one end 21*a* side of the first element 21, a power feeding portion 22 and a first bent portion 23 are provided. The first bent portion 23 is bent in a direction perpendicular to the substrate 10. The power feeding portion 22 is bent inward from the first bent portion 23 in an L-shape, and is electrically connected to one end 13*a* of the U-shaped strip line 13 of the substrate 10 by soldering or the like.

Figure 5:
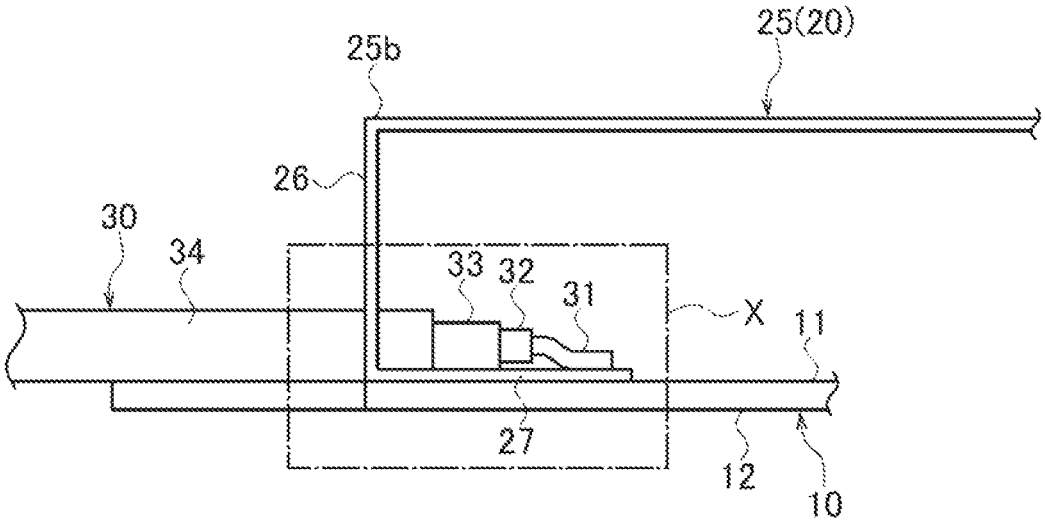
FIG. 5 is a side view of a main part of the antenna unit of the folded antenna according to the embodiment.

As illustrated in FIGS. 2, 3, and 5, the side of one end 25*a* of the second element 25 is connected to the side of the other end 21*b* of the first element 21 via a first folded portion 24. On the side of the other end 25*b* of the second element 25, a second folded portion (folded portion) 27 bent through a second bent portion (bent portion) 26 is provided. The second bent portion 26 is bent in a direction perpendicular to the substrate 10. The second folded portion 27 is further bent from the second folded portion 26 in a direction parallel to the substrate 10, and capacitively coupled via the dielectric base material 11 to the copper foil (ground) 12. That is, the second folded portion 27 is formed in the shape of a rectangular plate which is bent inward in an L-shape from the second folded portion 26. The impedance can be adjusted by adjusting an area of the second folded portion 27 by changing a width R of the second folded portion 27 without changing a height H of the second bent portion 26.

Each antenna element 20 is disposed on the surface 11*a* of the dielectric base material 11 such that the second folded portion 27 of the second element 25 is capacitively coupled to the copper foil (ground) 12 via the dielectric base material 11. This capacitive coupling is realized by soldering the second folded portion 27 to the fixing pattern 14 formed on the surface 11*a* of the dielectric base material 11. Thus, the substrate 10 can be used as the ground of the folded antenna 1. That is, if the position of the second folded portion 27 cannot be fixed with respect to the substrate 11, it is affected to the antenna characteristics. Thus the second folded portion 27 is fixed by soldering to the fixing pattern 11 formed on the surface 11*a* of the dielectric base material 11.

In addition, since the fixing pattern 14 is capacitively coupled to the copper foil (ground) 12 on the rear surface 11*b* of the dielectric base material 11 in the same manner as the second folded portion 27, it is also affected to the antenna characteristics. Thus it is necessary to perform a design (area, position, and the like of the fixing pattern 14) based on it. Here, for example, the fixing pattern 14 is formed in a T-shape or the like, and the area and position of the fixing pattern 14 in contact with the second folded portion 27 are varied.

Figure 7:
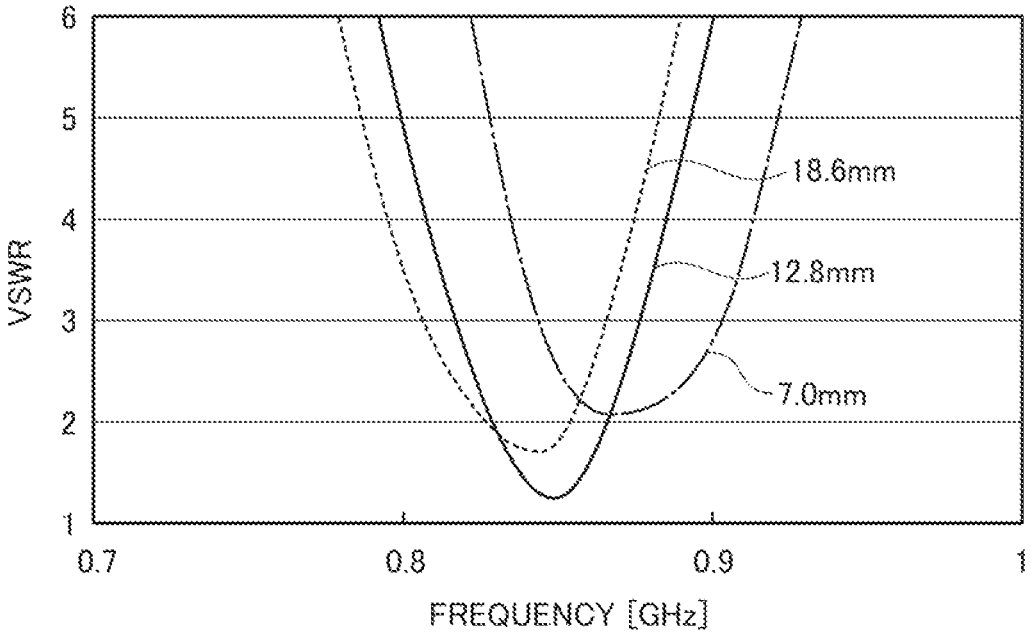
FIG. 7 is a graph illustrating frequency characteristics of the voltage standing wave ratio of the folded antenna according to the embodiment.

FIG. 7 is a graph illustrating the frequency characteristics of the voltage standing wave ratio (VSWR) of the folded antenna 1. Here, without changing the height H of the second bent portion 26 of the second element 25 of each antenna element 20, the width R of the second folded portion 27 was changed to 7.0 mm, 12.8 mm, and 18.6 mm, and the VSWR characteristics were measured for each of the cases where the area of the second folded portion 27 was adjusted. From the measurement results, it can be confirmed that the width dimension R is 12.8 mm and resonates most (the Q is high, that is, the electricity is easy to pass through).

As illustrated in FIG. 5, each coaxial cable 30 includes an inner conductor 31, an insulator 32, an outer conductor 33, and an outer sheath 34 in order from the inside to the outside of its cross section. As illustrated in FIG. 2, the inner conductor 31 is electrically connected to the other end 13*b* of the U-shaped strip line 13 of the substrate 13 by soldering or the like.

With the folded antenna 1 according to the embodiment, the impedance characteristics of the folded antenna 1 can be adjusted by controlling the capacitive coupling state of the antenna element 20 and the substrate 10 without changing the height of the antenna element 20 which increases the antenna gain. Specifically, without changing the height H of the second bent portion 26 of the second element 25, the width R of the second folded portion 27 is changed to 7.0 mm, 12.8 mm, and 18.6 mm, and the area of the second folded portion 27 is adjusted, whereby the impedance characteristic of the folded antenna 1 can be adjusted.

Thus, without changing the height H of the second bent portion 26 of the second element 25, the width R of the second folded portion 27 is changed to adjust the area of the second folded portion 27, thereby making it possible to increase the gain of the compact and low profile folded antenna 1 in the vertical polarization/horizontal plane as much as possible. That is, the impedance can be adjusted while the gain of the folded antenna 1 is kept high, and the input impedance can be stabilized.

Although the present embodiment has been described above, the present embodiment is not limited thereto, and various modifications can be made within the scope of the gist of the present embodiment.

That is, in the folded antenna 1 according to the embodiment, the second folded portion 27 of the second element 25 is formed in a rectangular plate shape, but the shape of the second folded portion 27 is not limited to a rectangular plate shape, and may be various shapes such as a triangular plate shape or a T-shaped plate shape.

In the folded antenna 1 according to the embodiment, the second folded portion 27 of the second element 25 is bent inward from the second bent portion 26 in an L-shape, but the second folded portion 27 may be bent outward from the second bent portion 26 in an L-shape.

Further, in the folded antenna 1 according to the embodiment, the second folded portion 27 of the second element 25 and the substrate 10 are fixed by soldering, but the second folded portion 27 and the substrate 10 may be fixed by an adhesive or the like.

Further, the folded antenna 1 according to the embodiment includes two antenna elements 20, but the number of antenna elements 20 may be one, or three or more.

What is claimed is:

1. A folded antenna, comprising:

a substrate comprising a dielectric base material and a ground disposed on a first surface of the dielectric base material; and an antenna element comprising a first element having, on one end side, a feeding portion and a first bent portion, and a second element continuously provided, on one end side thereof, with another end side of the first element via a first folding portion, and having, on another end side thereof, a second folded portion via a second bent portion, wherein the first bent portion and the second bent portion are bent in a direction perpendicular to the substrate, and the second folded portion further is bent in a direction parallel to the substrate from the second bent portion and capacitively coupled to the ground via the dielectric base material, and wherein an impedance of the folded antenna is configured to be adjusted by adjusting an area of the second folded portion by changing a width dimension of the second folded portion without changing a height dimension of the second bent portion.

2. The folded antenna of claim 1, wherein the ground is a copper foil formed on an entire surface of the first surface of the dielectric base material.

3. The folded antenna of claim 1, wherein the second folded portion is formed in a rectangular plate shape which is bent in an L-shape from the second bent portion, and the second folded portion having the rectangular plate-shape is fixed by soldering to a fixing pattern formed on a second surface of the dielectric base material.

4. The folded antenna according to claim 1, further comprising a second antenna element, separated from the antenna element, and provided symmetrically to the antenna element on the substrate, wherein the impedance is configured to be further adjusted by adjusting an area of a second folded portion of the second antenna element by changing a width dimension of the second folded portion of the second antenna element without changing a height dimension of a second bent portion of the second antenna element.

* * * * *